US010145202B2

(12) United States Patent
Anderson et al.

(10) Patent No.: US 10,145,202 B2
(45) Date of Patent: Dec. 4, 2018

(54) WEDGE SLIP TRAVEL STOP

(71) Applicant: BAKER HUGHES, A GE COMPANY, LLC, Houston, TX (US)

(72) Inventors: Gary L. Anderson, Humble, TX (US); James C. Doane, Friendswood, TX (US); Christopher D. Young, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/586,977

(22) Filed: May 4, 2017

(65) Prior Publication Data

US 2018/0023368 A1 Jan. 25, 2018

Related U.S. Application Data

(63) Continuation-in-part of application No. 15/214,202, filed on Jul. 19, 2016, now Pat. No. 10,077,624.

(51) Int. Cl.

| | |
|---|---|
| ***E21B 33/129*** | (2006.01) |
| ***E21B 33/128*** | (2006.01) |
| ***E21B 33/12*** | (2006.01) |
| ***E21B 23/00*** | (2006.01) |

(52) U.S. Cl.

CPC ..... *E21B 33/129* (2013.01); *E21B 23/00* (2013.01); *E21B 33/12* (2013.01); *E21B 33/128* (2013.01); *E21B 33/1208* (2013.01); *E21B 33/1293* (2013.01)

(58) Field of Classification Search

CPC ..... E21B 33/12; E21B 33/129; E21B 33/128

See application file for complete search history.

(56) References Cited

U.S. PATENT DOCUMENTS

| | | | | |
|---|---|---|---|---|
| 5,046,557 | A | 9/1991 | Manderscheid | |
| 5,174,397 | A * | 12/1992 | Currington | E21B 23/01 166/138 |
| 5,727,632 | A | 3/1998 | Richards | |
| 6,119,774 | A | 9/2000 | Doane et al. | |
| 6,715,560 | B2 * | 4/2004 | Doane | E21B 23/01 166/122 |
| 8,561,687 | B2 | 10/2013 | Moore et al. | |
| 2016/0251922 | A1 | 9/2016 | Eldho et al. | |

* cited by examiner

*Primary Examiner* — D. Andrews
*Assistant Examiner* — Tara E Schimpf
(74) *Attorney, Agent, or Firm* — Shawn Hunter

(57) ABSTRACT

A T-shaped slip is retained in an opening of a slip ring to drive the slip in opposed directions to and away from the surrounding borehole wall along a cone. The slip ring and cone do not come together when the slip is engaged. The opening allows release of a lock ring first with the slip engaged followed by release of the slip from the borehole wall. The slip ring and cone come together during removal from the borehole. A travel stop on the axial slip movement is provided to prevent guides on the slip from exiting a track or dovetail on the cone when the slip ring and cone are in contact during removal of the plug or packer. Extension of the guide from the cone track can happen if the slip moves through an enlarged portion of the borehole. The travel stop prevents this.

13 Claims, 9 Drawing Sheets

WEDGE SLIP TRAVEL STOP

CROSS REFERENCE TO RELATED APPLICATION

This application is a Continuation-in-Part and claims priority to U.S. application Ser. No. 15/214,202 filed on Jul. 19, 2016.

FIELD OF THE INVENTION

The field of this invention is packers or bridge plugs for borehole use and more particularly where the slips are edge guided and because of the configuration of the slips and the associated slip ring the slips are retained by a travel stop that prevents slip exit from the guides which could cause a loss of the slip as the packer or plug is pulled through larger tubulars than where it was originally set.

BACKGROUND OF THE INVENTION

There are a variety of slip designs in use and various techniques are used to retain the slips to a housing so that upon release of the packer or bridge plug the slips stay connected to the housing so that the slips come out in tandem with the housing. Most of these designs are concerned with limiting radial movement of slips pushed out radially during the set. Some examples of designs involving retaining movement of slips are: U.S. Pat. No. 8,561,687 (FIG. 6A item 605); US 2016/0251922 (FIG. 5A item 512 slip ring retainer); U.S. Pat. No. 5,046,557 (FIG. 3 items 38 and 52); U.S. Pat. No. 6,119,774 (FIG. 1 item 12); and U.S. Pat. No. 5,727,632 (FIG. 1*d* item 80).

As described below in an effort to reduce the length of a packer or plug there needed to be enough lost motion among the components so that the lock holding the packer or plug set position could release first before any movement to undermine an upper slip was undertaken. This was accomplished with added length to an opening that retains a transverse portion of a T-shaped slip so that enough lost motion for the mandrel could be had before grabbing the upper slip and pulling it uphole and away from its associated slip cone. The problem that can occur in such a modified design is that on the way out of the hole the packer or plug could run into larger tubulars than the size of tubular for which the packer or plug was intended to be set. When this happens the slip can slide down far enough to move out of its guides that are located on opposed sides. The present invention provides a travel stop to halt such movement before the slip guides can exit their guide channels. If that exit were to happen in a larger tubular then the slip can come out of the slip ring and can jam the packer or plug on the way out of the hole forcing a milling job. As an alternative travel stop the slip ring can have retainers that limit radial movement of the transverse portion of the T-shaped slip so that the slips will come out with the slip ring and will be incapable of falling out. This latter approach is more expensive to manufacture than the former solution but may be preferred in some cases. Those skilled in the art will better understand the underlying packer design and the slip travel stop feature applied to such a design from a review of the description of the preferred embodiment and the associated drawings while recognizing that the full scope of the invention is to be found in the appended claims.

Setting and unsetting of downhole tools is a common activity in the hydrocarbon exploration and recovery industry. Also due to the many different kinds of tools to be set and unset, there are various iteration of the setting and unsetting arrangements to support the goal. While many exist and function well for their intended purposes, it is also always a desire in the industry to improve efficiency, reduce cost and or improve function of all downhole tools. Arrangements then that reduce length, reduce unwanted motion in favor of facilitating wanted motion and combining functions are all desirable to the art.

SUMMARY OF THE INVENTION

An embodiment of a gripping arrangement includes a mandrel having an axially extending groove therein, a first slip ring about the mandrel, a first cone about the mandrel spaced from the first slip ring, and a key engaged with the groove such that the key is axially movable and rotationally fixed relative to the mandrel. The key is disposed to maintain the spacing between the first slip ring and the first cone. The gripping arrangement also includes a release feature releasably interconnected with the key.

An embodiment of a gripping arrangement includes a mandrel having an axially extending groove therein, a first slip ring about the mandrel, a first cone about the mandrel spaced from the first slip ring, and a key engaged with the groove and configured to be loaded to unset the gripping arrangement.

An embodiment of a method for unsetting a gripping arrangement including a mandrel having an axially extending groove therein, a first slip ring about the mandrel, a first cone about the mandrel spaced from the first slip ring, and a key engaged with the groove such that the key is axially movable and rotationally fixed relative to the mandrel. The key is disposed to maintain the spacing between the first slip ring and the first cone. The gripping arrangement also includes a release feature releasably interconnected with the key the arrangement further including a second slip ring and, a second cone interactive with the second slip ring, the method including pulling on the second slip ring and the mandrel, increasing distance the second slip ring and the second cone, shifting the mandrel relative to the key, contacting the key on a shoulder of the groove, moving the first cone with the key away from the first slip ring.

BRIEF DESCRIPTION OF THE DRAWINGS

The following descriptions should not be considered limiting in any way. With reference to the accompanying drawings, like elements are numbered alike.

DETAILED DESCRIPTION OF THE PREFERRED EMBODIMENT

A detailed description of one or more embodiments of the disclosed apparatus and method are presented herein by way of exemplification and not limitation with reference to the Figures.

Figure 1:
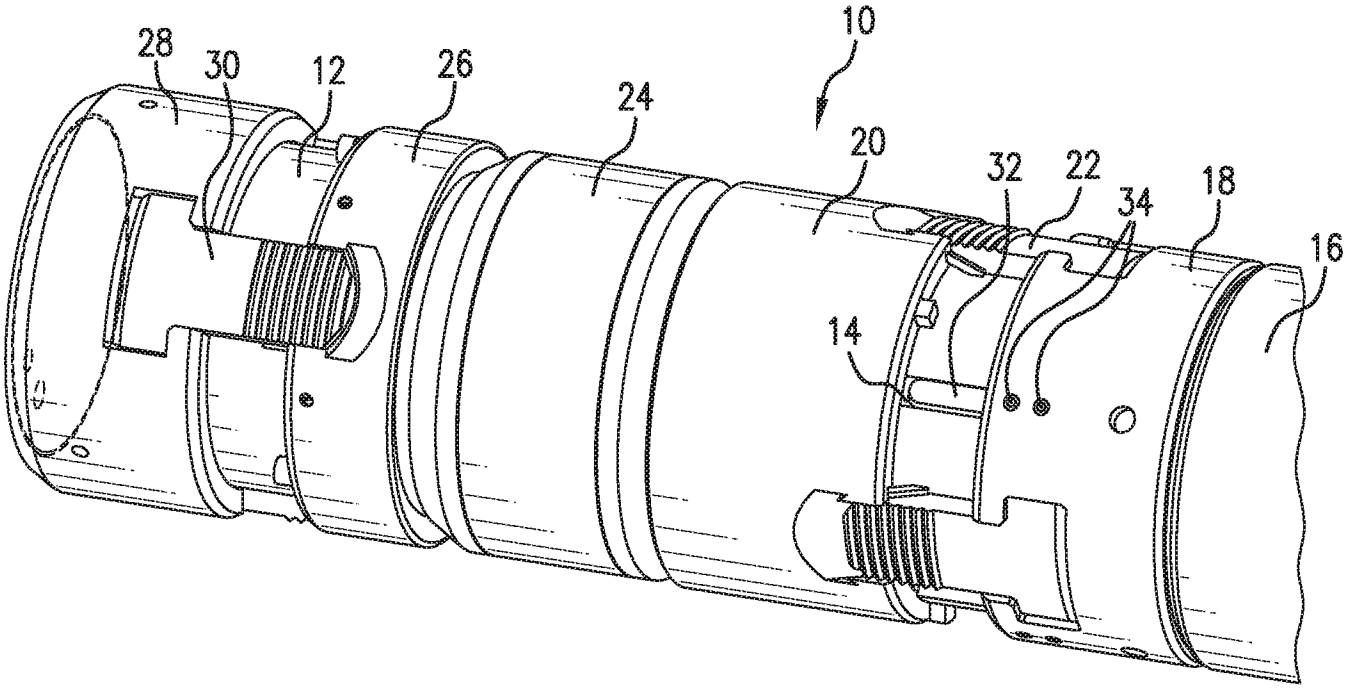
FIG. 1 is a perspective view of an embodiment of a gripping arrangement as disclosed herein.

Referring to FIG. 1, a perspective view of a gripping arrangement 10 is illustrated. The arrangement 10 includes a mandrel 12 that extends through other components of the arrangement that are introduced hereunder. The mandrel 12 includes a groove 14 therein that has varying lengths in different embodiments, to be discussed hereunder (see FIG. 2). Upon the mandrel 12 are (arbitrarily introduced from downhole end to uphole end) a piston housing 16; a first slip ring 18; a first cone 20; slips 22; seal 24; second cone 26; second slip ring 28 and slips 30. Also visible is key 32 and release feature 34. The key 32 enables setting of the gripping arrangement without unwanted movement of the mandrel 12 relative to a structure 36 such as a casing string (see FIG. 2) in which the gripping arrangement is to be set. This is accomplished by delaying the setting of the slips 22 due to an interfering condition the key 32 instigates between the first slip ring 18 and the first cone 20. More specifically, the key 32 prevents the slip ring 18 being urged nearer the first cone 20 until other conditions precedent are met. This, then, prevents the interaction of the slips 22 with the cone 20 to move slips 22 radially outwardly into engage the structure 36. The delay in engagement of slips 22 ensures that the slips 30 will engage the structure first. Engaging slips 30 first provides reliable location of the gripping arrangement 10 in the structure 36. The key 32 is also beneficial in the unsetting operation also discussed more fully hereinafter. Finally, key 32 inhibits rotational movement of the mandrel 12 relative to other components of the gripping arrangement 10. FIG. 1 and the foregoing information will provide one of ordinary skill in the art an overview for visual perspective while reviewing the following discussion wherein additional components are introduced and discussed.

FIGS. 2-6, cross sectional views of the embodiment of FIG. 1 allow for the introduction of some additional components not visible in FIG. 1 and to provide a sequence view illustrating the setting and unsetting movements of the gripping arrangement 10.

Figure 2:
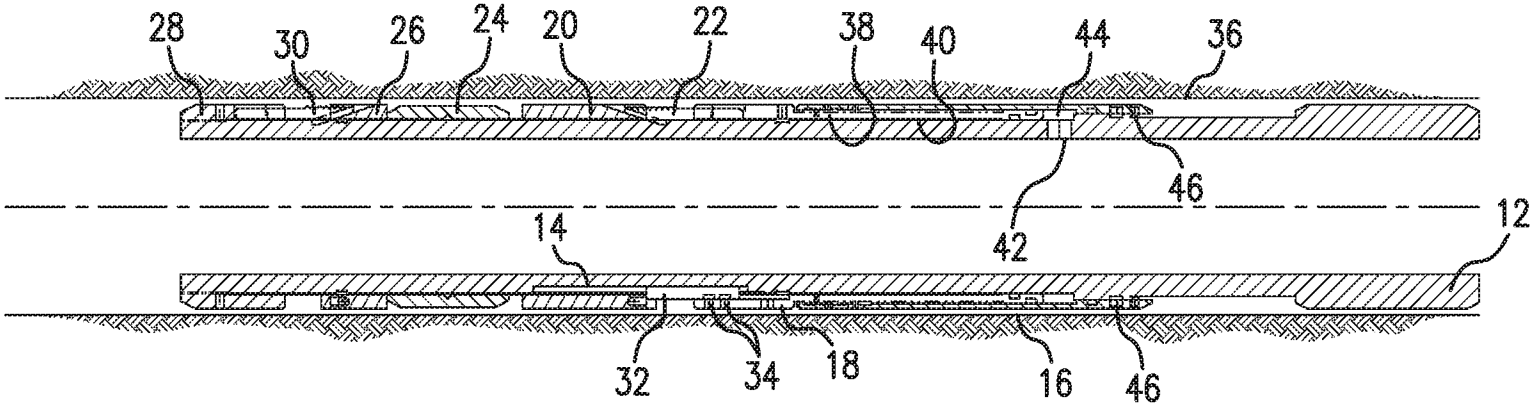
FIG. 2 is a cross section view of the embodiment of FIG. 1 in a run in condition.

Referring to FIG. 2, a body lock ring 38 of piston housing 16 is shown. This feature is embodiment specific in that the illustrated embodiment employs hydraulic pressure to set the arrangement 10. Due hereto, the slip ring 18 includes a piston 40 extending therefrom or at least in contact therewith (in an embodiment where the piston 40 is a separate member from the first slip ring 18). Pressure through port 42 acts on chamber 44 and hence piston 40 to urge the piston and the first slip ring 18 in the direction of second slip ring 28. The body lock ring 38 prevents relative movement of the piston housing 16 and the piston 40 in a direction opposite the direction the applied hydraulic pressure urged the piston. It will also be noted that piston housing 16 is attached to the mandrel 12 through a releasable attachment 46, such as shear screws, whose function it is to allow for movement of mandrel 12 to unset the gripping arrangement at a later time.

Figure 3:
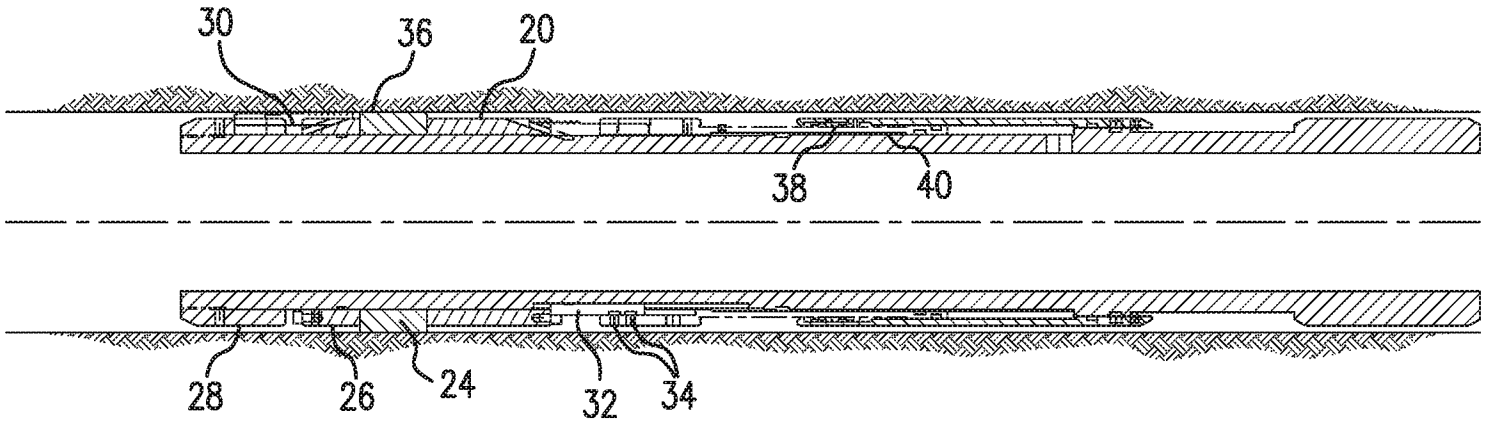
FIG. 3 is a cross section view of the embodiment of FIG. 1 in a partially set condition.

Moving to FIG. 3, it can be seen that the piston 40 has moved a distance toward the second slip ring 28, due to fluid pressure enlarging the chamber 44. During this movement, the force generated by fluid pressure is transferred through the piston 40, the first slip ring 18, the release feature 34, the key 32, the cone 20, the seal 24 and the second cone 26 to cause the slips 30 to interact with the second cone 26 and move radially outwardly into engagement with the structure 36.

Once the slips 30 bite into the structure 36, the second cone 26 becomes essentially immobile and the force generated from the piston 40 is taken up by the seal 24. In the case of a compression element, seal 24 is compressed and radially expanded into sealing contact with the structure 36. As the seal 24 fills any void spaces, it becomes immobile since in the compression seal embodiment it is inherently incompressible and the first cone 20 becomes consequently immobile.

Figure 4:
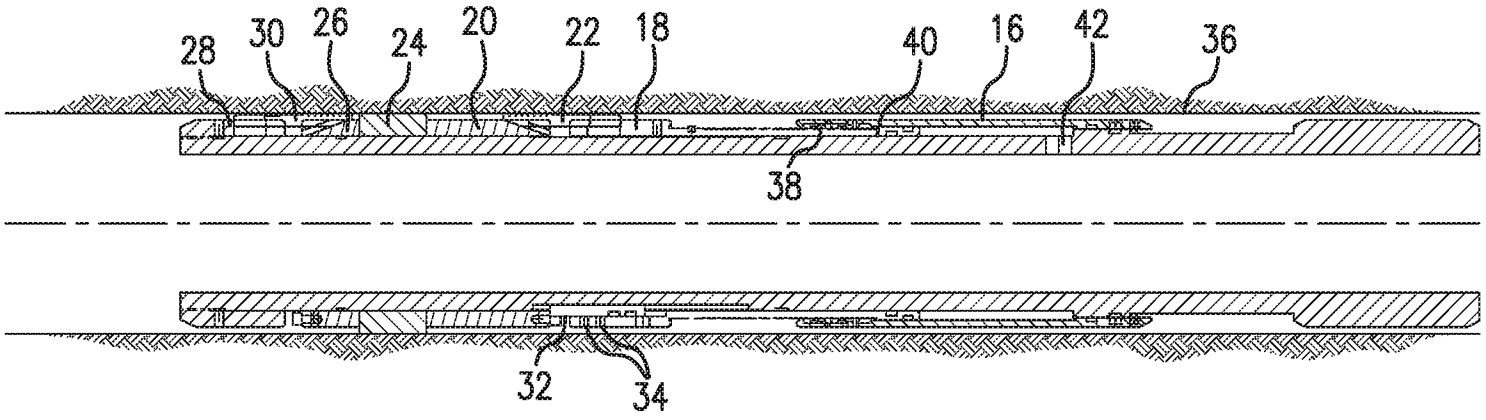
FIG. 4 is a cross section view of the embodiment of FIG. 1 in a fully set condition.
Figure 4A:
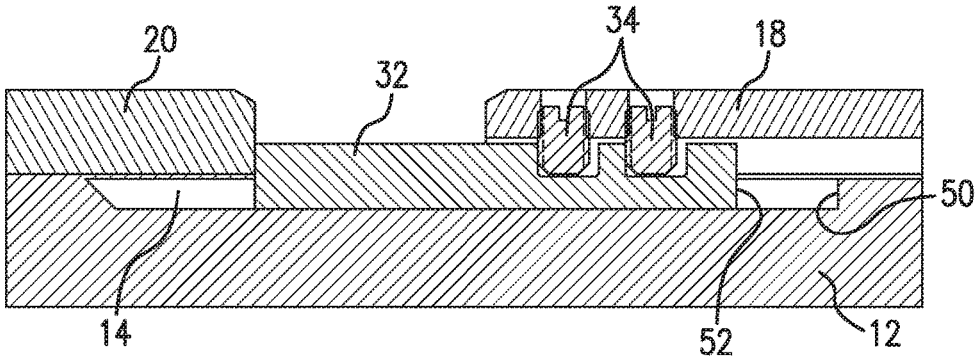
FIG. 4*a* is an enlarged view of a portion of the embodiment of FIG. 1.

Referring to FIG. 4, force from the piston 40 is pitted against the immobile first cone 20 loading the key 32 and the release feature 34, which in the illustrated embodiment attaches the key to the first slip ring 18. FIG. 4*a* is a detail view of the key 32 in the groove 14 in one embodiment. It is noted that in this embodiment the groove extends underneath the cone 20 hence requiring the cone is axially longer for the embodiment than it would have to be for the alternate embodiment illustrated in FIG. 7. Once a release threshold is achieved, the release feature 34 releases (as illustrated shear screws shear) and the first slip ring 18 is free to move into greater proximity with the first cone 20. Resultantly, the slips 22 interact with the first cone 20 moving radially outwardly into contact with the structure 36. The gripping arrangement 10 will remain set in this position until further intervention is taken.

Figure 5:
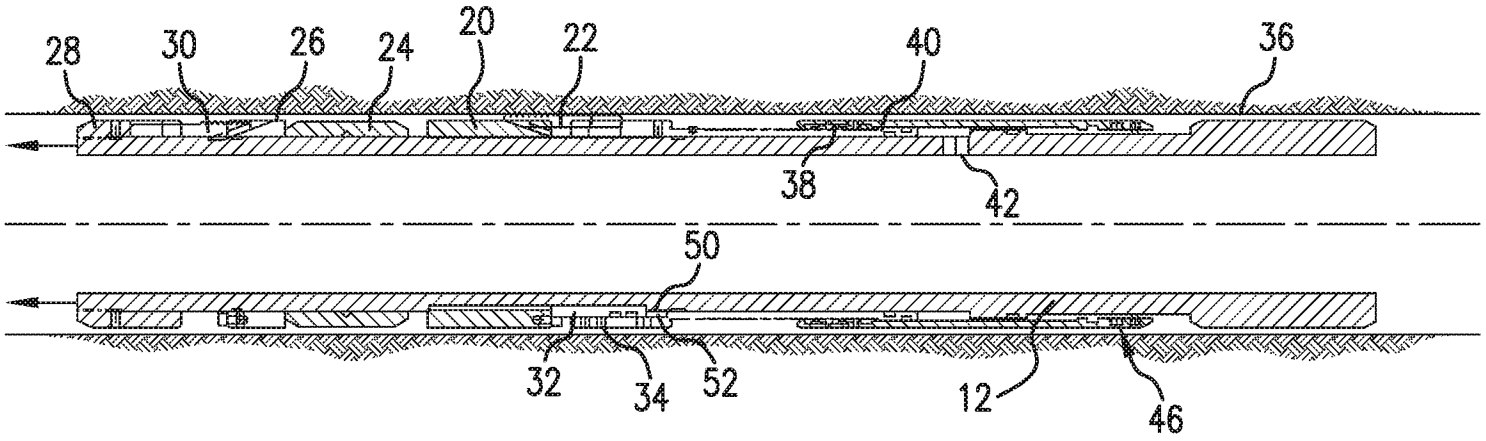
FIG. 5 is a cross section view of the embodiment of FIG. 1 in a partially unset condition.
Figure 6:
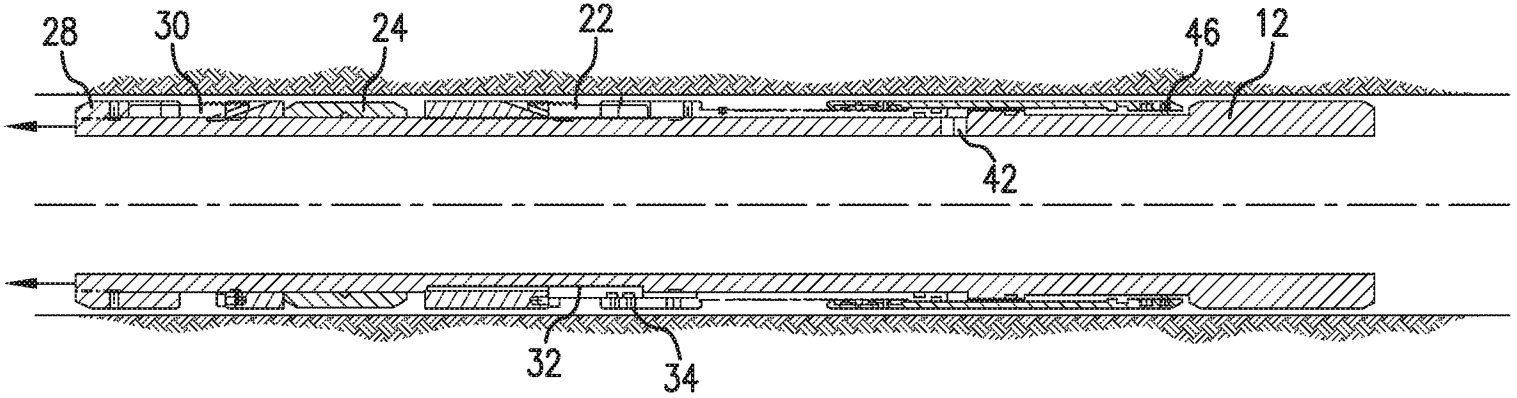
FIG. 6 is a cross section view of the embodiment of FIG. 1 in a fully unset condition.

Referring to FIG. 5, in order to unset the gripping arrangement 10, a straight pull on the second slip ring 28 or mandrel 12 is all that is necessary. The first action to occur subsequent to application of a tensile force on the gripping arrangement 10 through the second slip ring 28 or the mandrel 12 is that releasable attachment 46 will release at a selected force. This allows the mandrel 12 to move leftward in the figures sliding on piston 40. Next, the slips 30 are pulled down the second cone 26 and out of engagement with the structure 36. The energy trapped in the seal 24 will then dissipate upon additional movement of the mandrel in the leftward direction of the figures hereof. As a shoulder 50 of groove 14 (see FIG. 4*a*) contacts end 52 of key 32, the key 32 is moved leftward into forced contact with first cone 20 (see FIG. 6) thereby unsupporting the slips 22. At this point the gripping arrangement 10 is unset and may be moved.

Figure 7:
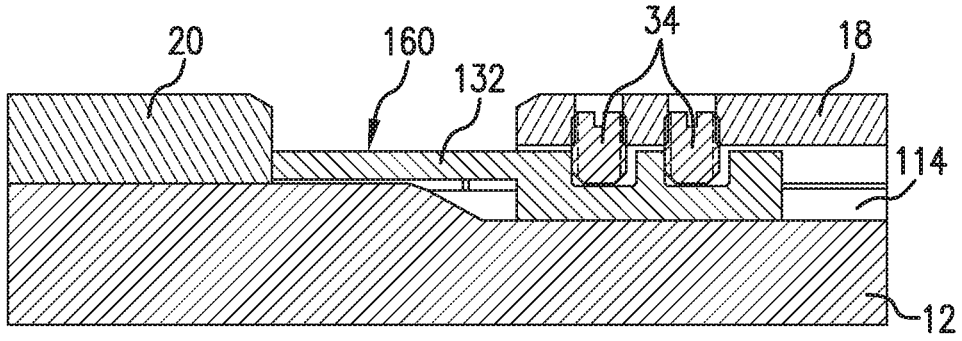
FIG. 7 is an enlarged view of a portion of an alternate embodiment, the figure being the equivalent of FIG. 4*a* in the FIG. 1 embodiment.

In an alternate embodiment, referring to FIG. 7, a key 132 includes an offset portion 160 that does not extend into the groove 114 in mandrel 12. This allows the groove 114 to be shorter and resultantly the cone 20 to be shorter axially. Benefits of the arrangement are a shorter overall length of the gripping arrangement in this embodiment while maintaining the rotational lock benefit of the foregoing embodiment.

Embodiment 1

A gripping arrangement includes a mandrel having an axially extending groove therein, a first slip ring about the mandrel, a first cone about the mandrel spaced from the first slip ring, a key engaged with the groove such that the key is axially movable and rotationally fixed relative to the mandrel, the key disposed to maintain the spacing between the first slip ring and the first cone, and a release feature releasably interconnected with the key.

Embodiment 2

The gripping arrangement of any prior embodiment, wherein the key includes an offset.

Embodiment 3

The gripping arrangement of any prior embodiment wherein the release feature is a shear element.

Embodiment 4

The gripping arrangement of any prior embodiment, wherein the release feature connects the key to the first slip ring.

Embodiment 5

The gripping arrangement of any prior embodiment, further including a slip interactive with the first slip ring and the first cone.

Embodiment 6

The gripping arrangement of any prior embodiment, wherein the slip is prevented from setting by the key until the release feature releases.

Embodiment 7

The gripping arrangement of any prior embodiment, wherein the groove includes a shoulder configured to drive the kay to unset the gripping arrangement.

Embodiment 8

A gripping arrangement including a mandrel having an axially extending groove herein, a first slip ring about the mandrel, a first cone about the mandrel spaced from the first slip ring, a key engaged with the groove and configured to be loaded to unset the gripping arrangement.

Embodiment 9

A method for setting a gripping arrangement including running the gripping arrangement of any prior embodiment, the arrangement further comprising a second slip ring and, a second cone interactive with the slip ring, actuating the second slip ring and cone while delaying actuation of the first slip ring and cone, releasing the release feature, actuating the first slip ring and the first cone.

Embodiment 10

The method of any prior embodiment, further including deploying a seal.

Embodiment 11

The method of any prior embodiment, wherein the seal is disposed between the first and second cone.

Embodiment 12

The method of any prior embodiment, wherein the seal is a compression element.

Embodiment 13

The method for unsetting a gripping arrangement of any prior embodiment, the arrangement further including a second slip ring and, a second cone interactive with the second slip ring, the method including pulling on the second slip ring and the mandrel, increasing distance the second slip ring and the second cone, shifting the mandrel relative to the key, contacting the key on a shoulder of the groove, moving the first cone with the key away from the first slip ring.

Figure 9:
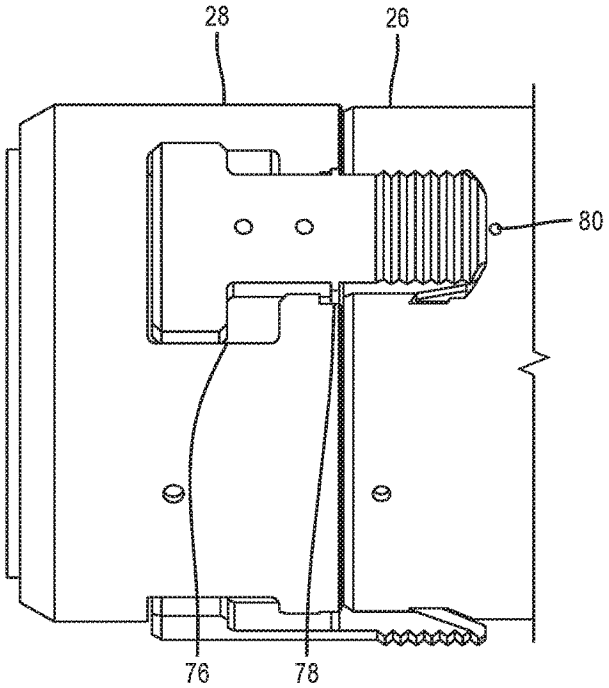
FIG. 9 is the view of FIG. 8 in the released position of the packer or plug during removal from the borehole.
Figure 8:
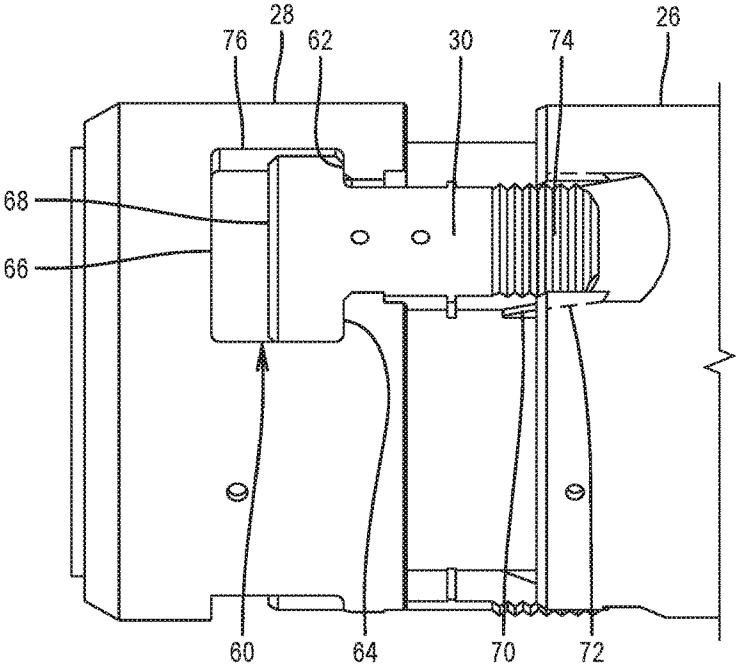
FIG. 8 shows the relative positions of rings 28 and 26 in the run in position.

In the packer or plug design described above or in other designs that have a T-shape slip 30 an opening 60 has a bottom surface 62 to support transverse surface 64 of slip 30 for running in as shown in FIG. 9. Ultimately during the setting that brings slip ring 28 and cone 26 closer together but not into contact a force is delivered to move slips 30 axially as surface 66 engages surface 68 on slip 30. Opposed guides 70 (only one of which is seen) slide in a track or dovetail 72 until the wickers 74 engage a surrounding tubular that is not shown. The axial movement of the slip 30 leaves the guides 70 still in track or dovetail 72 at the time the wickers 74 engage the borehole wall. The set position does not bring slip ring 28 and cone 26 together but it does allow the surface 66 to push on surface 68 of slip 30 enough to move the wickers 74 to the borehole wall.

The released position of the packer or bridge plug is shown in FIG. 9. The slip ring 28 and the cone 26 are together. However, because the height 76 of opening 60 is configured to allow lost motion so that lock ring 38 can be released before slips 30, there is a possibility that on removal of the packer or plug the borehole wall is enlarged. If there is no axial restraint on the downward movement of slips 30 during the removal and with slip ring 28 against cone 30, there is a way for slips 30 to continue axial travel to the point where the guides 70 can come out of the track or dovetail 72 and literally fall out of opening 60. Opposed tabs 78 engage cone 26 before guides 70 can move axially out of track or dovetail 72. In that manner the engagement of the guides 70 to the track or dovetail 72 continues even if an increase in the borehole diameter on the way out of the hole allows further axial travel of the slips 30. That axial movement is stopped by tab or tabs 78 to avoid loss of any slip 30 which could potentially jam the packer or plug in the borehole and require a milling operation. An alternative way to avoid loss of slips 30 during removal is to add a radial surface to the height 76 to limit the outward radial movement of the slips 30. This technique requires making the slip ring 28 far more costly to manufacture and the preferred technique to avoid slip 30 loss is the addition of one or two tabs or other travel stop devices to slip 30 axial movement before guides 70 can exit track or dovetail 72. Another alternative can be to place a pin or other travel stopping surface 80 for the slip 30 on the cone 26 at a location where the guides 70 are still in track or dovetail 72.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anticorrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

We claim:

1. A retention system for a slip assembly for a packer or bridge plug, comprising:

relatively axially movable slip ring and cone on a mandrel, said slip ring selectively contacting at least one slip to drive said at least one slip on said cone and to retract said at least one slip from said cone while said slip is guided by said cone for axial movement to contact and retract from a surrounding borehole wall; and said at least one slip continues to be guided at a location remote from where said slip ring selectively contacts said at least one slip, said guiding continuing to be operable when said slip ring and said cone come into contact after said retracting said at least one slip at a first location in a borehole wall and moving said at least one slip to a second and larger dimension of the borehole due to a travel stop located outside of said guiding and selectively engaging said cone for limiting relative axial movement of said at least one slip relative to said slip ring so that said guiding continues to radially retain said at least one slip to said slip ring against falling out in the larger dimension of the borehole.

2. The system of claim 1, wherein:

said travel stop located on said at least one slip that engages said cone.

3. The system of claim 1, wherein:

said travel stop located on said slip ring that engages said at least one slip.

4. The system of claim 1, wherein:

said travel stop located on said cone that engages said at least one slip.

5. The system of claim 1, wherein:

said slip ring comprising an opening retaining a transverse portion of said at least one slip, said at least one slip comprising an axial portion extending from said opening beyond an end of said slip ring for contact with said cone;

said transverse portion having opposed sides selectively contacted by opposed sides of said opening for moving said at least one slip axially relatively to said cone in opposed directions.

6. The system of claim 5, wherein:

said travel stop limits axial movement of said axial portion of said at least one slip when said slip ring is in contact with said cone to retain said axial portion within said opening.

7. The system of claim 6, wherein:

said transverse portion of said at least one slip not in contact with said opposed sides of said opening when said travel stop halts axial movement of said at least one slip.

8. The system of claim 7, wherein:

said travel stop is located on said at least one slip.

9. The system of claim 8, wherein:

said travel stop comprises at least one tab extending transversely from said axial portion of said at least one slip.

10. The system of claim 7, wherein:

said travel stop located on said cone.

11. The system of claim 10, wherein:

said travel stop comprises a pin on a ramp of said cone.

12. The system of claim 7, wherein:

said travel stop is located in said opening of said slip ring.

13. The system of claim 12, wherein:

said travel stop comprises opposed radial surfaces on said opening that overly said transverse portion of said at least one slip.

* * * * *